US009279636B1

(12) United States Patent
Nash et al.

(10) Patent No.: US 9,279,636 B1
(45) Date of Patent: Mar. 8, 2016

(54) PROJECTILE LAUNCHER

(71) Applicants: Peter B. Nash, Norton Shores, MI (US); Richard Whitney Nash, Allegan, MI (US)

(72) Inventors: Peter B. Nash, Norton Shores, MI (US); Richard Whitney Nash, Allegan, MI (US)

( * ) Notice: Subject to any disclaimer, the term of this patent is extended or adjusted under 35 U.S.C. 154(b) by 0 days.

(21) Appl. No.: 14/511,468

(22) Filed: Oct. 10, 2014

(51) Int. Cl.
*F41B 7/00* (2006.01)

(52) U.S. Cl.
CPC ..... *F41B 7/003* (2013.01)

(58) Field of Classification Search
CPC ..... H02G 1/04; H02G 1/08; H02G 1/085; F41B 7/00; F41B 12/68; F41B 3/005; A01K 91/02
USPC ..... 254/134.3 R; 124/16, 26, 27, 280
See application file for complete search history.

(56) References Cited

U.S. PATENT DOCUMENTS

| | | | | | |
|---|---|---|---|---|---|
| 1,468,373 | A | * | 9/1923 | Blake | 43/135 |
| 2,000,146 | A | * | 5/1935 | Penn | 43/6 |
| 2,348,040 | A | * | 5/1944 | Vieths | 124/27 |
| 2,779,323 | A | * | 1/1957 | Thomsen | 124/27 |
| 2,888,768 | A | * | 6/1959 | Taylor | 42/1.14 |
| 2,955,586 | A | * | 10/1960 | Hamrick | 124/57 |
| 3,004,533 | A | * | 10/1961 | Ritz | 124/27 |
| 3,026,864 | A | * | 3/1962 | Gray | 124/27 |
| 3,059,630 | A | * | 10/1962 | Oreskey | 124/27 |
| 3,430,620 | A | * | 3/1969 | Davis | 124/27 |
| 3,949,731 | A | * | 4/1976 | Caso | 124/27 |
| 3,968,784 | A | * | 7/1976 | Miller | 124/27 |
| 4,056,859 | A | * | 11/1977 | Pace | 7/107 |
| 4,195,615 | A | * | 4/1980 | Belokin | 124/16 |
| 4,256,077 | A | * | 3/1981 | Munson | 124/26 |
| 4,386,478 | A | * | 6/1983 | Belokin | 43/135 |
| 4,386,598 | A | * | 6/1983 | Blaser | 124/21 |
| 5,243,955 | A | * | 9/1993 | Farless | 124/20.1 |
| 5,355,866 | A | * | 10/1994 | Hunter | 124/26 |
| 5,491,924 | A | * | 2/1996 | Athanasiadis | 43/19 |
| 5,493,807 | A | | 2/1996 | Sullins | |
| 5,551,412 | A | * | 9/1996 | Warnke | 124/20.1 |
| 5,582,392 | A | * | 12/1996 | Bajric et al. | 254/134.3 R |
| 5,887,577 | A | | 3/1999 | Sherrill | |
| 6,209,531 | B1 | | 4/2001 | Boon | |
| 6,244,261 | B1 | * | 6/2001 | West, Jr. | 124/60 |
| 6,286,495 | B1 | | 9/2001 | Brown | |
| 7,140,596 | B2 | * | 11/2006 | Hayes | 254/134.3 FT |
| 7,182,317 | B2 | * | 2/2007 | Rivers et al. | 254/134.3 FT |
| 7,448,371 | B2 | * | 11/2008 | Sapir | 124/16 |
| 7,918,219 | B2 | * | 4/2011 | Belokin | 124/81 |

* cited by examiner

*Primary Examiner* — Lee D Wilson
*Assistant Examiner* — Jamal Daniel
(74) *Attorney, Agent, or Firm* — Gardner, Linn, Burkhart & Flory, LLP

(57) ABSTRACT

A projectile launcher includes a barrel mount, a tubular barrel, and a biasing member disposed in the barrel. The barrel mount can assume a barrel-securing configuration and a barrel-releasing configuration in which the barrel is longitudinally movable relative to the barrel mount from a forward position to a rearward position. The biasing member is compressible from an initial relaxed position to a first compressed position with the barrel in the rearward position, and to a second (further) compressed position the barrel in the forward position. The projectile can thus be launched at different speeds according to the barrel position. The launcher may also include a trigger release, a handgrip, and indicia markings on the barrel to denote approximate launch distance or other information. Optionally, the projectile is attached to a lead line that loops over a tree branch upon launching, such as for suspending a food container at a campsite.

20 Claims, 14 Drawing Sheets

PROJECTILE LAUNCHER

FIELD OF THE INVENTION

The present invention relates generally to projectile launchers and, in particular, to projectile launchers that utilize a spring or other compressible member to store energy for launching a projectile.

BACKGROUND OF THE INVENTION

For purposes of safely storing food bags or containers in wilderness areas, such as during camping activities, it is known to tie a cord to a rock and manually throw the rock over a tree branch. If done correctly, the rock will loop over the branch, carrying the cord with it, and then dangle from the branch. The user can then pull down on the cord to raise a food bag sufficiently high above the ground so that a bear or other animal cannot access the bag from the ground. However, it can take many attempts to loop a cord over a desired branch in this manner, as the rock can easily come untied from the cord, and it can be very difficult to manually throw the rock substantially vertically so as to loop over a desired branch without missing or catching on other branches.

SUMMARY OF THE INVENTION

The projectile launcher of the present invention is particularly well suited for applications in which it is desired to launch a projectile to a desired height above ground, without overshooting, and without substantial horizontal travel of the projectile. The launcher can also be used to launch a projectile a desired horizontal distance. The projectile launcher is compact, lightweight, and compared to manual throwing in particular, use of the launcher increases the likelihood that a user will achieve the desired result on the first attempt. By connecting a lightweight line to the projectile, the projectile launcher may be set for a desired launch height to launch the projectile and the attached line over a specific branch of a tree with reasonable accuracy. The projectile launcher can be easily set for a particular desired launch height, then loaded, aimed, and triggered, with reduced likelihood of entanglements, misses, or other undesired outcomes.

According to one form of the present invention, a projectile launcher includes a barrel mount, a tubular barrel, and a biasing member disposed in the barrel. The barrel mount is configurable between a barrel-securing configuration and a barrel-releasing configuration. When the barrel mount is in the barrel-releasing configuration, the barrel is longitudinally movable, relative to the barrel mount, between a forward position and a rearward position. The biasing member (such as a coil spring or the like) is compressible from a relaxed position to one of at least two different compressed positions according to the position of the barrel relative to the barrel mount. The biasing member is compressible to a first compressed position when the barrel is in the forward position, and the biasing member is compressible to a second compressed position when the barrel is in the rearward position. Thus, when a projectile is positioned in the barrel, it can be ejected from the barrel at different speeds by the biasing member corresponding to the compressed position, which is determined by the position of the barrel relative to the barrel mount.

In one aspect, when the barrel is in the forward position, it projects forwardly beyond the barrel mount a distance that is greater than when the barrel is at the rearward position.

Optionally, the barrel may be continuously adjustable between a forwardmost position and a rearward most position, to achieve substantially any desired compressed position of the biasing member.

In another aspect, the barrel has indicia spaced longitudinally along an outer surface thereof. The indicia correspond to at least the forward and rearward positions of the barrel. Optionally, the indicia are indicative of an approximate launch height for a projectile when the barrel is at an indicated position, and may include numbers that refer to different launch heights, such as in feet, yards, or meters. Optionally, the indicia indicate energy stored by the biasing member or the distance of compression of the biasing member, the expected muzzle velocity of a known projectile, or other useful information that corresponds to a given barrel position.

In yet another aspect, the biasing member is more compressed when it is in the first compressed position than when it is in the second compressed position. Thus, when the projectile is ejected from the barrel in the forward position, the projectile speed is greater than when the projectile is ejected from barrel in the rearward position.

In still another aspect, the projectile launcher includes a trigger that selectively retains the biasing member in either of the first or second compressed positions. The trigger is movable to a releasing position to release the biasing member to the relaxed position, which launches the projectile from the barrel.

In a further aspect, a plug or sabot is positioned in the barrel, forwardly of the biasing member. The sabot engages the projectile during launch, and is configured to be selectively engaged by the trigger to retain the biasing member in the first or second compressed position.

In a still further aspect, the barrel defines a longitudinal slot and the trigger has an engaging projection that extends inwardly through the longitudinal slot to engage the sabot when the trigger is in a retaining position. Optionally, the sabot has a projection that extends outwardly through the longitudinal slot, and the sabot projection is engaged by the trigger outside of the barrel when the trigger is in a retaining position.

In a still further aspect, the barrel mount has a clamping element that permits tightening of the barrel mount around the barrel in the barrel-securing configuration. Optionally, an elongate ridge extends longitudinally along an outer surface of the barrel, and a slot is defined in the barrel mount for receiving the elongate ridge. The barrel mount maintains the barrel in a rotationally fixed position, via engagement of the elongate ridge in the slot. Optionally, the barrel mount clamps to the elongate ridge.

In another aspect, a projectile assembly is provided for use with the projectile launcher. The projectile assembly includes a projectile and a flexible line that is releasably coupled to the projectile. Optionally, the projectile is coupled to the flexible line via a releasable magnetic coupling, or by a releasable clip or swivel-snap clip or the like.

According to another form of the present invention, a method is provided for launching a projectile. The method includes positioning a tubular barrel at a desired one of two or more different longitudinal positions relative to a barrel mount, according to a desired projectile launch distance or launch height. The barrel is fixed relative to the barrel mount at a desired position according to the desired launch height or distance or velocity, and a projectile is loaded into a forward open end of the barrel. Loading of the projectile includes compressing a biasing member in the barrel from an extended/relaxed configuration to one of at least two different available compressed positions that corresponds to the desired launch distance or height of the projectile, and which generally corresponds to the desired one of the at least two different longitudinal positions of the barrel. The biasing member is retained in the compressed position, and is then released to eject the projectile from the barrel. The speed of the projectile exiting the barrel generally corresponds to the longitudinal position of the barrel relative to the barrel mount.

In one aspect, a first of the longitudinal positions corresponds to a forward position of the barrel relative to the barrel mount, and a second of longitudinal positions corresponds to a rearward position of the barrel relative to the barrel mount. In this arrangement, the speed of the projectile exiting the barrel is greater when the barrel is in the forward position than when the barrel is in the rearward position.

In another aspect, the method includes attaching a flexible line to the projectile, selecting a desired longitudinal position of the barrel according to the height of a selected tree branch, aiming the tubular barrel generally at or above the tree branch prior to the releasing of the biasing member, so that releasing the biasing member causes the projectile and the flexible line to loop over the tree branch. The flexible line is then attached to a container line associated with a container, the flexible line is pulled or drawn in so that the container line is pulled or drawn over the tree branch, and the container is raised by pulling the container line so that the container is supported at the tree branch a desired height above the ground.

Optionally, the projectile is detachable from the flexible line via a quick-disconnect coupling, prior to attaching the flexible line to the container line.

Thus, the present invention provides a projectile launcher that can be used to secure food containers or the like a desired height above ground. The launcher is easy to use and sufficiently accurate to allow a user to loop a flexible line over a desired tree branch, with a reasonably high likelihood of success on the first attempt. In some embodiments, the projectile is readily removable from the lightweight line, which limits the risk of entanglement and facilitates drawing a heavier container line over an elevated branch. The projectile launcher may also be used in target games, or as an educational aid or demonstration tool, such as in teaching physics principles, and is sufficiently compact and lightweight so as to easily fit in backpacks or the like.

These and other objects, advantages, purposes and features of the present invention will become apparent upon review of the following specification in conjunction with the drawings.

DESCRIPTION OF THE PREFERRED EMBODIMENTS

The present invention is directed to a projectile launcher that may be used for various purposes, including launching a lightweight lead line attached to a small projectile over a tree branch, such as for use in hoisting and suspending a food container above the ground, or for use in target games. Although the projectile launcher can be scaled in size and power for various different uses, it is envisioned that embodiments of the projectile launcher can be made particularly compact and lightweight so as to be suitable for backpacking and camping. The power of the launcher is adjustable for each launch, so that the muzzle velocity of the projectile can be selected according to the needs of a user, such as for launching the projectile over a particular branch of a tree, or for hitting a ground-based target that is a known distance from the user.

Figure 1:
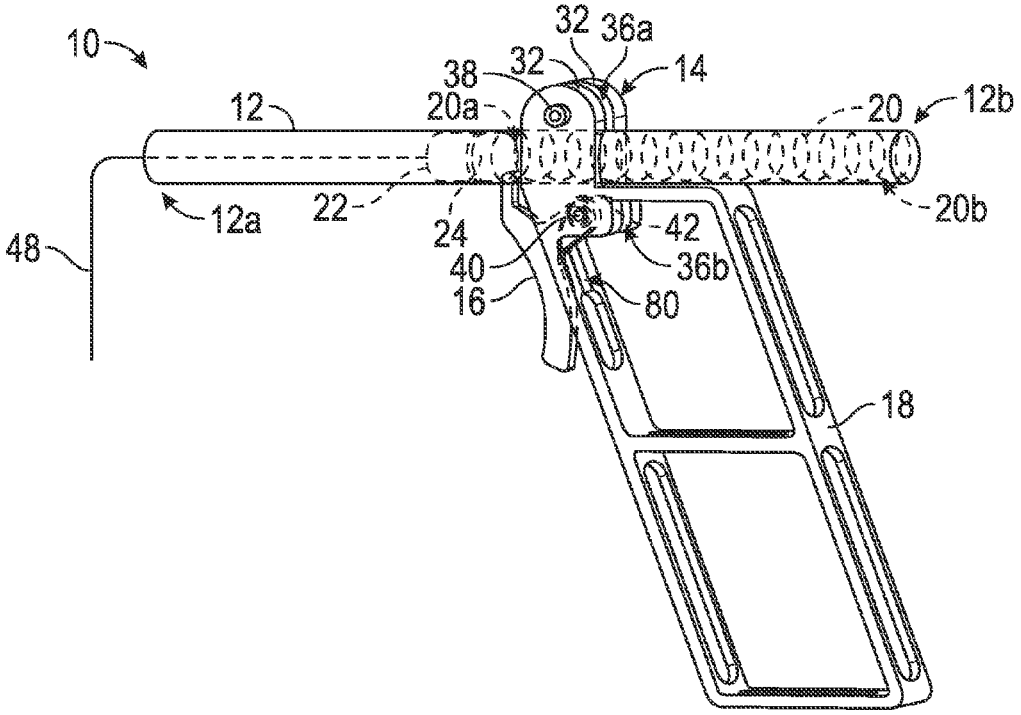
FIG. 1 is a side perspective view of a projectile launcher in accordance with the present invention, showing the barrel in a rearward position.
Figure 2:
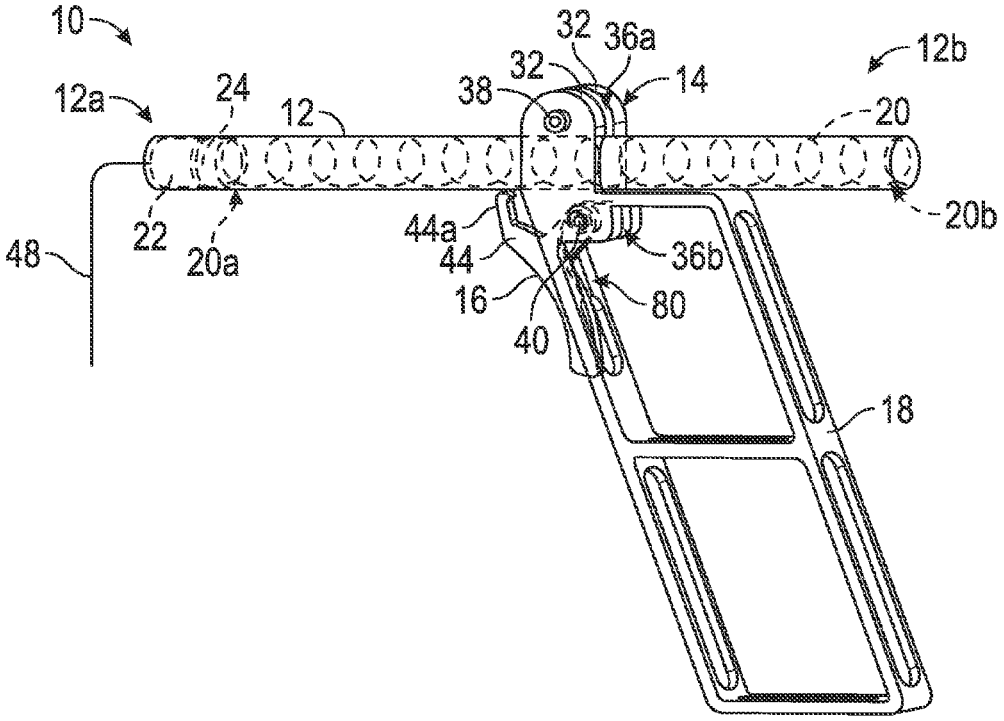
FIG. 2 is another side perspective view of the projectile launcher, shown just prior to the projectile being ejected from a forward end of the barrel.
Figure 16A:
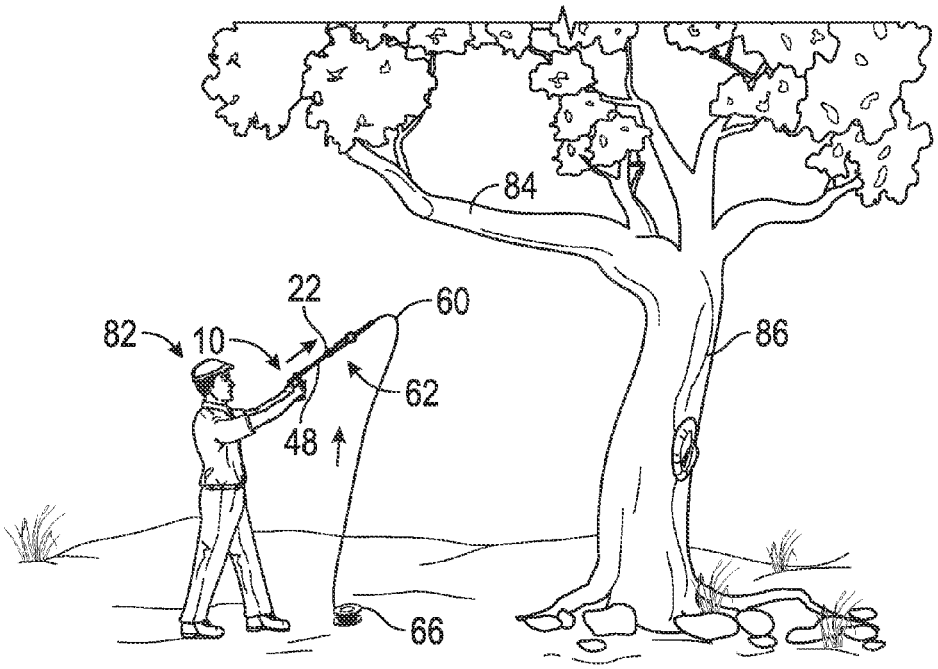
FIGS. 16A-16F are perspective views depicting a method of using the projectile launcher for suspending a container from a tree branch.

Referring now to the drawings and the illustrative embodiments depicted therein, a projectile launcher 10 includes a tubular barrel 12 that is supported in a barrel mount 14, which permits barrel 12 to be slid or moved forward and rearward relative to a trigger 16 that is coupled to barrel mount 14 (FIGS. 1-5). Barrel mount 14 and trigger 16 are positioned at an upper end portion of a handgrip or gripping portion 18, which extends downwardly below barrel 12. Trigger 16 is pivotably coupled to handgrip 18, and is spring-biased forwardly, or in the clockwise direction as viewed in FIGS. 1-5. A biasing member such as a coil spring 20 is located inside barrel 12, and can be retained in a compressed, energy-storing configuration (FIGS. 1 and 3) and subsequently released by trigger 16 to launch a projectile 22 out of a forward or muzzle end 12*a* of barrel 12 (FIGS. 2 and 16A). An optional plug or sabot 24 is positioned at a forward end 20*a* of spring 20 (FIGS. 1-3) for positioning projectile 22 at a desired location in barrel 12, and for selectively engaging trigger 16, as will be described in more detail below.

Figure 3:
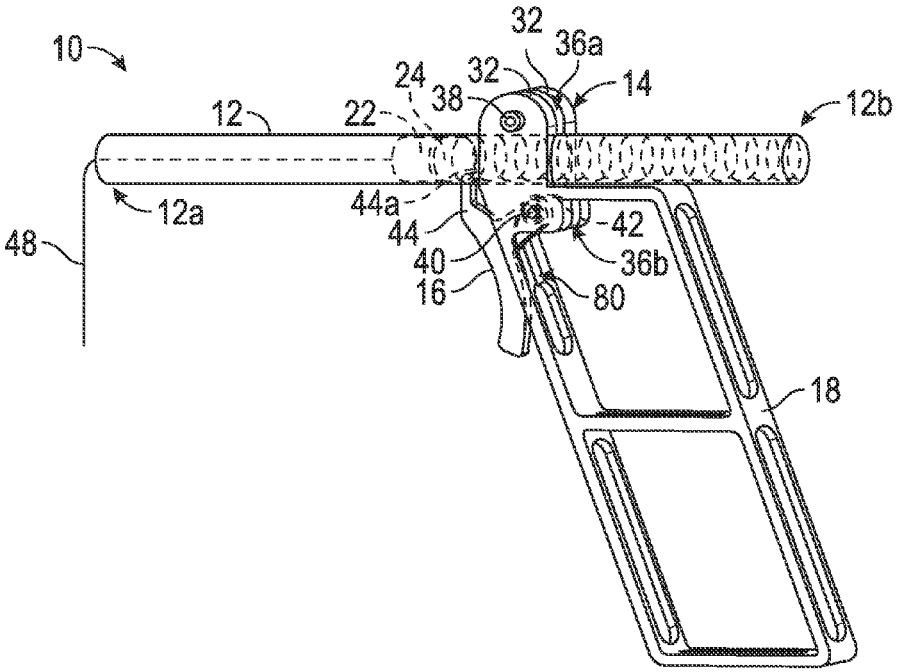
FIG. 3 is another side perspective view of the projectile launcher of FIG. 1, shown with the barrel in a position that is slightly forward of the position of FIGS. 1 and 2.
Figure 5:
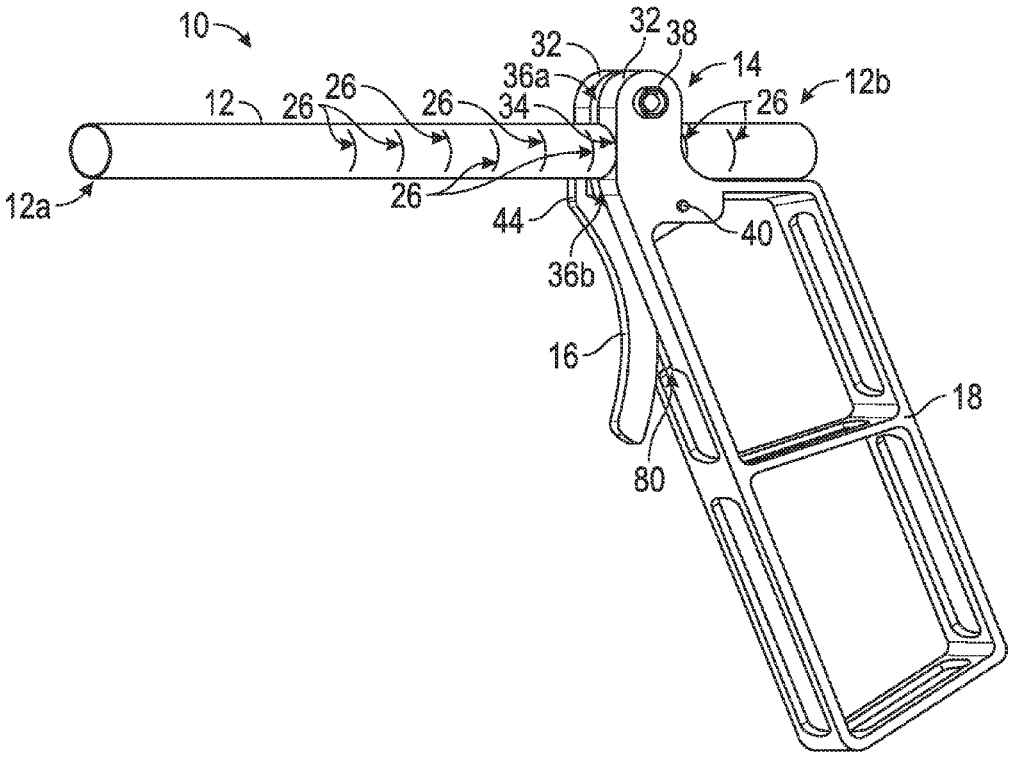
FIG. 5 is a front perspective view of the projectile launcher of FIG. 1, shown with the barrel in a forward position.
Figure 8:
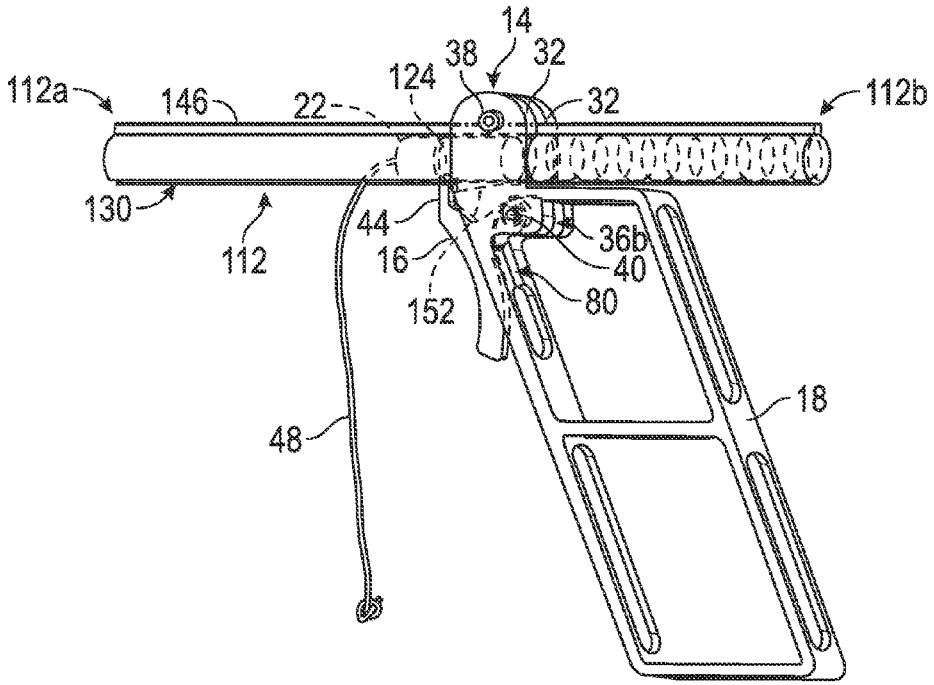
FIG. 8 is another side perspective view of the projectile launcher of FIG. 7, shown loaded and cocked for launching of a projectile, and with the barrel in a more rearward position and an optional sabot.
Figure 9:
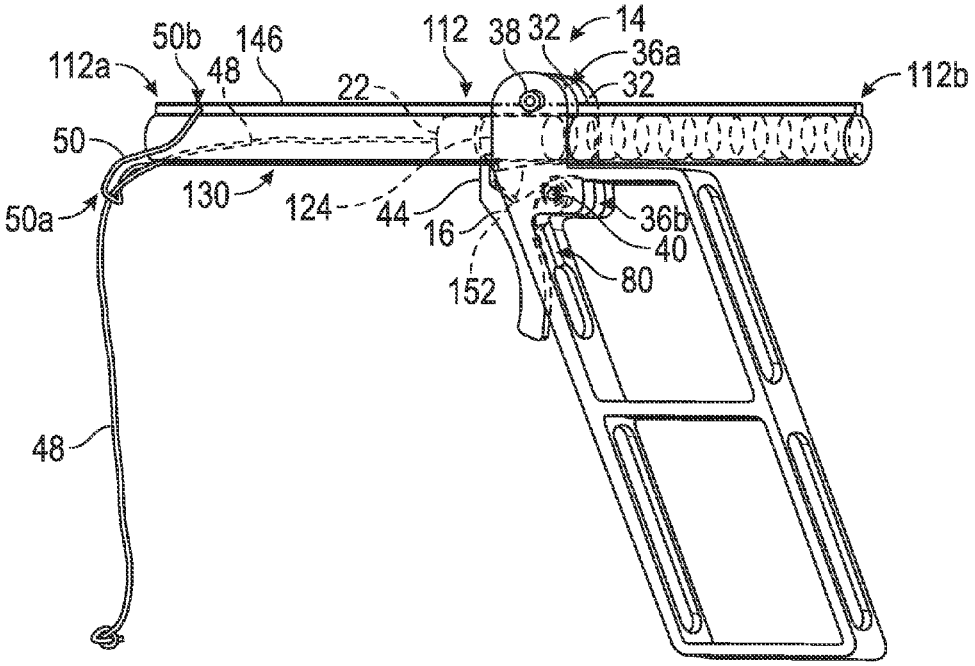
FIG. 9 is another side perspective view of the projectile launcher of FIG. 8, shown fitted with a line-positioning clip.
Figure 10:
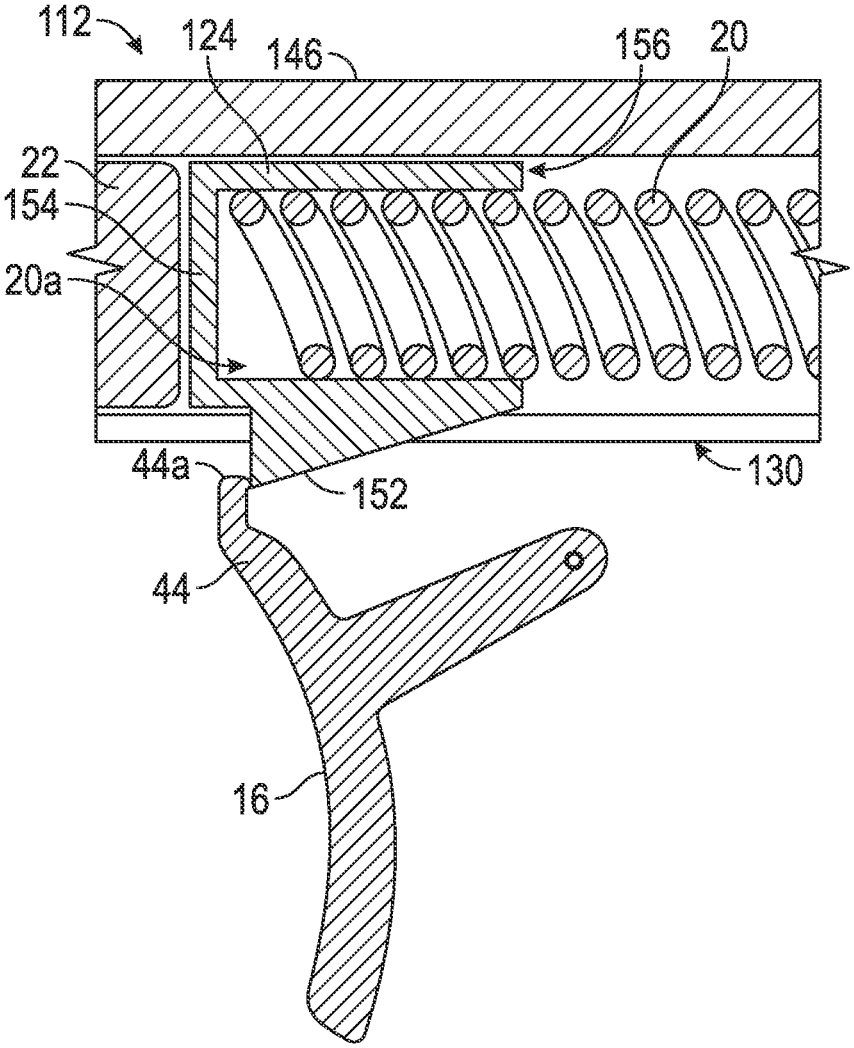
FIG. 10 is an enlarged side sectional view of the trigger, barrel, and sabot region of the projectile launcher of FIGS. 8 and 9.

Tubular barrel 12 is generally cylindrical in shape and has an open forward end portion 12*a* and a closed rear end portion 12*b*. A rear end 20*b* of spring 20 is positioned at rear end portion 12*b* of barrel 12, so that the barrel's rear end portion 12*b* serves as a backstop for spring 20 (FIGS. 1-3). Rear end portion 20*b* of spring 20 may be fixedly secured at rear end portion 12*b* of barrel 12, so that spring 20 is retained in barrel 12 during launching of projectile 22. Barrel 12 further defines an elongate longitudinal slot (or, optionally, a plurality of longitudinally-spaced openings) along a lower surface thereof, which permits an upper engaging portion of the trigger to enter barrel 12 through slot 30 to engage sabot 24, such as shown in FIGS. 8-10, and as will be described in more detail below. Longitudinal slot 30 may extend along a substantial portion of the length of barrel 12, and may extend fully to forward end 12*a* of barrel 12, or may terminate near forward end 12*a* so that the forward end remains completely circular, such as shown in FIGS. 5-6D.

In the illustrated embodiment, barrel 12 is completely removable from barrel mount 14 by loosening the barrel mount and then moving the barrel forward or rearward in a longitudinal direction until it is free of the barrel mount. This can facilitate packing or storing the projectile launcher 10 in tight spaces, and also facilitates exchanging one barrel for another. For example, different barrels may be provided for different uses, and may contain springs having different spring rates, have different barrel lengths or slot arrangements, different indicia, or the like. In another embodiment, the barrel has an open rear end that is configured to receive an end cap, to which a spring is attached. For example, the rear end of the barrel may have a threaded inner surface or outer surface, and the end cap may have a correspondingly threaded outer or inner surface. This allows the end cap can be threadedly secured to the barrel with the associated spring disposed inside the barrel, facilitates the use of different springs in the same barrel, and also facilitates cleaning and/or lubrication of the barrel through the open rear end thereof. Other attachment structures are also envisioned for securing an end cap to the barrel, such as a twist-lock arrangement.

Optionally, barrel 12 has a plurality of markings or other indicia 26 along an outer surface 28 of the barrel. Indicia 26 provide a user with a visual reference for determining the position of barrel 12 relative to barrel mount 14. Indicia 26 may include numbers or other symbols or markings that are indicative of an approximate projectile launch height that may be expected when using projectile launcher 10 to eject a known projectile 22 (i.e., having a known size and weight) in a generally vertical direction, such as shown in FIG. 5. Optionally, the indicia can indicate energy stored by the biasing member, the distance of compression of the biasing member, the expected muzzle velocity of a known projectile, or other useful information that corresponds to a given barrel position. It will be appreciated that, for launch consistency and correlation of expected projectile performance to some types of indicia markings (e.g., launch height or muzzle velocity), it is desirable to use a projectile with a consistent size, shape, and density, and to use a consistent launch angle, so that the projectile launch distance and/or height is generally repeatable for a given position of barrel 12 and the corresponding compressed position of spring 20. Because the rearward indicia would align with barrel mount 14 when barrel 12 is positioned forwardly along the barrel mount (corresponding to greater compression of spring 20), indicia numbers corresponding to launch height or muzzle velocity will increase in magnitude from the forward-most indicia to the rearward-most indicia.

In one embodiment, the barrel is a generally cylindrical tube having an outer diameter of approximately 13 mm, an inner diameter of approximately 11 mm, a length of approximately 165 mm, and a slot having a width of approximately 3 mm and extending a longitudinal distance of approximately 140 mm rearward from the forward end 12*a* of barrel 12. Barrel 12 may be made from aluminum alloy tubing or other metal, or of resinous plastic, fiber, reinforced plastic, or substantially any other sufficiently strong material. Spring 20 may be a helical coiled wire compression spring having an outside diameter of approximately 10 m, a wire diameter of approximately 1 mm, a pitch of approximately 6 mm in the relaxed-expanded configuration, and a length of approximately 150 mm of the expanded configuration. Optionally, compression spring 20 has a generally cylindrical plug at its rear end 20*b* for securing spring 20 at the rear end portion 12*b* of barrel 12. The cylindrical plug may have an outer diameter of slightly greater than 11 mm so as to create a friction-fit inside an 11 mm inner diameter of barrel 12, for example. It will be appreciated that an alternative biasing member, in the form of any sufficiently resilient compressible member or device, may substitute for coil spring 20. For example, a compressible rubber or rubber-like cylinder, or an air spring (e.g., having a telescoping inner member that fits tightly in a hollow air-filled outer cylinder) may be placed in the barrel to provide the necessary force to eject the projectile from the barrel, and would operate in a substantially similar manner as coil spring 20.

As shown in FIGS. 1-5, barrel mount 14 includes a pair of upwardly-extending clamp portions 32 that cooperate to provide an elongate space 34 through which barrel 12 is received (FIGS. 4 and 5) and is permitted to slide when barrel mount 14 is in a loosened, barrel-releasing configuration. Clamp portions 32 further define an additional upper clamping space 36*a* above elongate space 34 and barrel 12, which permits clamp portions 32 to be drawn together upon tightening of a clamping member 38. Clamping member 38 is tightenable to draw clamp portions 32 together, thereby achieving a barrel-securing configuration of barrel mount 14, whereby barrel 12 is squeezed between the clamp portions 32 and secured in a fixed longitudinal position relative to barrel mount 14 and trigger 16.

In the illustrated embodiments, clamping member 38 is a threaded fastener with an exposed head portion (shown) and with a threaded distal end portion that is received in a threaded bore formed in the opposite clamp portion 32. In the illustrated embodiment, barrel mount 14 extends below barrel 12 to include a forward-upper portion of handgrip 18, including a lower clamping space 36*b* that is contiguous with elongate space 34 and upper clamping space 36*a* when barrel 12 is not present. Upper and lower clamping spaces 36*a*, 36*b* facilitate tightening of clamp portions 32 around barrel 12. Moreover, it will be appreciated that barrel mount 14 may be unitarily formed with handgrip 18, such as in the manner shown.

A tool such as a hexagonal wrench or a screwdriver may be used to rotate clamping member 38, to thereby loosen or tighten clamp portions 32 around barrel 12. For example, a hexagonal wrench 39 is shown in phantom in FIG. 14 for illustrative purposes. However, it will be appreciated that other types of clamping members or barrel-securing arrangements or mechanisms may be used, such as hand-tightenable fasteners (e.g. wing nuts, over-center cam levers, or the like) that do not require the use of a separate tool. It is further envisioned that non-clamping barrel mounts may be used, such as a barrel mount having a longitudinal opening for the barrel and a lateral opening that intersects the longitudinal opening, where the lateral opening is capable of receiving a cross-pin or shaft that can engage an opening, groove, or notch formed in the outer surface of the barrel, thus allowing the barrel to be secured in any longitudinal position (relative to the barrel mount) in which a receiving opening or groove in the outer surface of the barrel can receive the removable pin that passes laterally through the barrel mount.

Trigger 16 is pivotably coupled to handgrip 18 via a pivot pin 40 that extends through respective aligned openings formed in an upper end portion of the handgrip 18, which may be unitarily formed with a lower end portion of barrel mount 14, as described above. A torsion spring 42 is disposed around pivot pin 40 (FIGS. 1 and 3), with opposite spring end portions that extend out engage a backside of trigger 16 and an upper surface of handgrip 18. Spring 42 biases trigger 16 in the clockwise direction as viewed in FIGS. 1-5. Trigger 16 includes an upper projection 44 with tip portion 44*a* that extends through longitudinal slot 30 in barrel 12 and engages a recess formed in a lower surface of sabot 24, to thereby retain sabot 24 and spring 20 in a ready-to-launch configuration when projectile 22 is positioned against sabot 24, such as shown in FIGS. 1 and 3. When a user pulls rearwardly on trigger 16, tip portion 44*a* disengages sabot 24, which is then pushed forwardly through barrel 12 by spring 20 to eject projectile 22 from forward end 12*a* of barrel 12. Sabot 24 and spring 20 are retained in barrel 12 by connection of rearward end 20*b* of spring 20 at rear end 12*b* of barrel 12 (FIG. 2), such as via a friction fit or a cured adhesive. Sabot 24 is an optional component, and it will be appreciated that the trigger's tip portion 44*a* may directly engage end portion 20*a* of spring 20, or may directly engage the projectile, particularly if the projectile incorporates a circumferential groove or ring-like projection, collar, or shoulder for receiving the tip portion 44*a*, such as will be more fully described below with reference to FIGS. 13 and 14.

Figure 4:
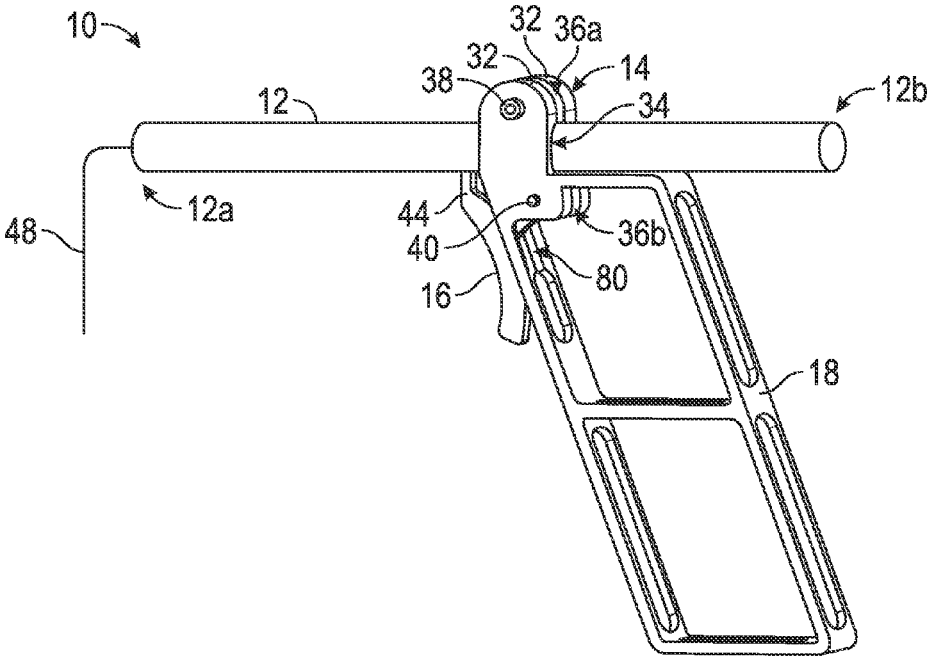
FIG. 4 is another side perspective view of the projectile launcher of FIG. 3, in which phantom lines are omitted.

To adjust the exit or launch velocity of projectile 22, clamping member 38 is loosened to permit sliding of barrel 12 relative to barrel mount 14 in a forward or rearward direction. When barrel 12 is moved rearward, as in FIGS. 1 and 2, spring 20 will be less compressed when sabot 24 is engaged by the tip portion 44*a* of the trigger's upper projection 44, as compared to when barrel 12 is slid forwardly such as shown in FIGS. 3 and 4, an especially when barrel 12 is slid further forward as shown in FIGS. 5-6D. When barrel 12 is slid forward and spring 20 is more compressed, projectile 22 will exit at a higher velocity than when barrel 12 is secured in a rearward position, so that projectile 22 would be expected to travel higher and/or farther when barrel 12 is in a more forward position relative to barrel mount 14. As described above, indicia 26 provide a user with a visual reference so that the user may select an appropriate barrel position, relative to barrel mount 14, for achieving a desired launch height or distance for projectile 22. In the illustrated embodiment, barrel 12 is continuously or infinitely adjustable between a forwardmost position and a rearward most position, to achieve substantially any desired compressed position of spring 20.

Figure 7:
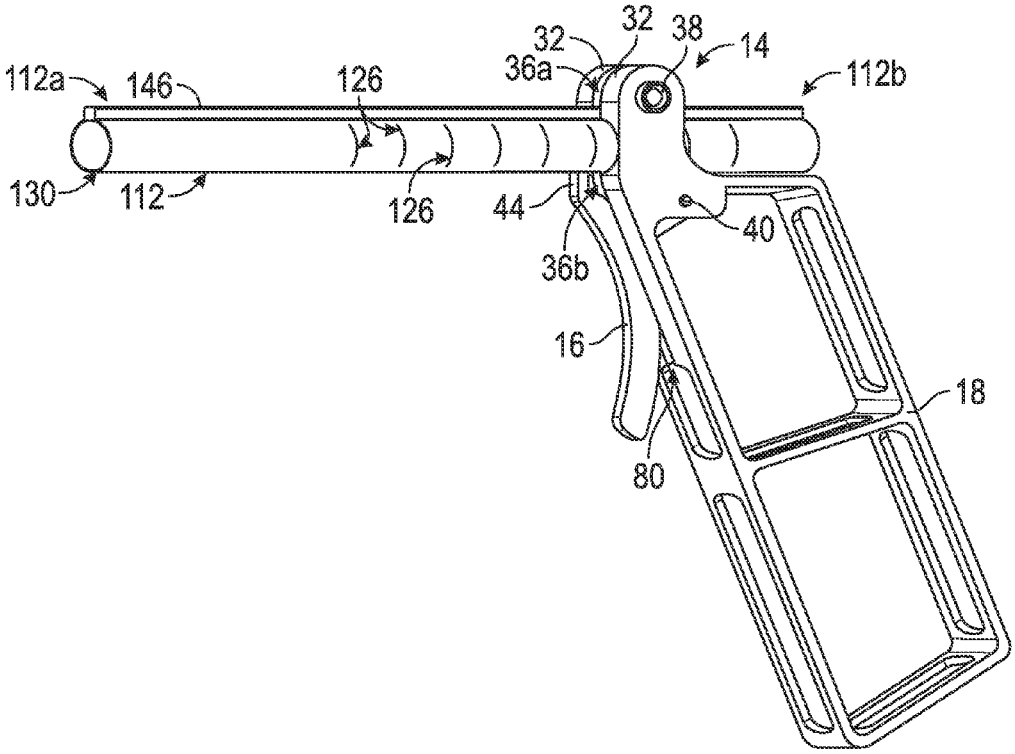
FIG. 7 is a side perspective view of another projectile launcher in accordance with the present invention, showing the barrel in a forward position.

Optionally, and with reference to FIGS. 7-9, it is envisioned that a barrel 112 may include an alignment projection that also facilitates clamping by the barrel mount 14. Tubular barrel 112 is similar to barrel 12 described above, but includes a bottom longitudinal slot 130 that extends fully to forward end 112*a*, and has an upwardly-extending longitudinal protrusion or wall 146 that extends the full length of barrel 112, opposite from longitudinal slot 130 along the bottom of barrel 112. Upper protrusion 146 is received in the upper clamping space 36*a* of barrel mount 14 where it passes between clamp portions 32. This maintains rotational alignment of barrel 112 relative to barrel mount 14, and also maintains alignment of upper projection 44 of trigger 16 with longitudinal slot 130, regardless of the longitudinal position of barrel 112 relative to barrel mount 14 and trigger 16. Moreover, upper protrusion 146 provides an additional clamping region that is engaged by inner surfaces of clamping portions 32 (at upper clamping space 36*a*) upon tightening of clamping member 38, so that barrel 112 can be secured at barrel mount 14 without distorting the barrel 112 due to over-tightening of clamping member 38. It will be appreciated that the upwardly-extending longitudinal protrusion or wall may extend along only a portion of the length of the barrel, so that the wall is received in the upper clamping space 36*a* only along the normal range of travel of the barrel 112 relative to barrel mount 14.

When projectile launcher 10 is used for launching a line, such as for suspending a food container from a tree branch at a campsite, a lightweight flexible projectile line 48 is attached to projectile 22 when the projectile is loaded into barrel 12. For example, projectile line 48 may be a monofilament or multi-strand fishing line, and for some applications may preferably be a high-modulus (low stretch) line, as will be described below. In the case of tubular barrel 12 having longitudinal slot 30 that terminates prior to forward end 12*a*, projectile line 48 extends out the forward end 12*a* of barrel 12 prior to launching a projectile 22, such as shown in FIGS. 1-4. However, in the case of longitudinal slot 130 that extends fully to the forward end 112*a* of barrel 12 (FIG. 8), projectile line 48 may be expected to drop through longitudinal slot 130 near where it connects to projectile 22. Optionally, and as shown in FIG. 9, a support clip 50 may be mounted at or near forward end 112*a* of barrel 112, and includes a distal loop end 50*a* that supports projectile line 48 at a location outside of barrel 112, such as forwardly of forward end 112*a*. Support clip 50 has respective proximal ends 50*b* that attach to barrel 112, such as at upper protrusion 146. Optionally, support clip 50 is pivotable between a use position (shown) and a non-use position in which the support clip is pivoted to lie against barrel 112 in an out of the way position. When support clip 50 is in use, it ensures that projectile line 48 exits barrel 112 at or near forward end 112*a*, and reduces the likelihood of abrading the projectile line 48 along the barrel edge surfaces that define longitudinal slot 130.

In the illustrated embodiment of FIGS. 1-7, sabot 24 has a lower recess that receives tip portion 44*a* of the upper projection 44 of trigger 16, where tip portion 44*a* extends through longitudinal slot 30 to engage sabot 24. However, it will be appreciated that, in an alternative arrangement of FIGS. 8-10, a sabot 124 may have a lower trigger-catch 152 that protrudes outwardly through a lower end of barrel 112, through longitudinal slot 130. Aside from trigger catch 152, sabot 124 is substantially in the shape of a hollow cylinder having a slightly smaller outer diameter than the inner diameter of barrel 112. As shown in FIG. 10, sabot 124 has a circular forward wall 154 that abuts projectile 22 during launching of the projectile, and defines a cylindrical cavity 156 that is open at its rearward end. The sabot's cylindrical cavity 156 receives forward end portion 20*a* of spring 20 and, optionally, the spring's forward end portion 20*a* may be permanently or removably secured in cylindrical cavity 156 (such as via a friction fit or with a cured adhesive or the like), so that sabot 124 is retained on spring 20, which is retained at its rearward end 20*b* at the rearward end portion 112*b* of barrel 112.

Figure 13:
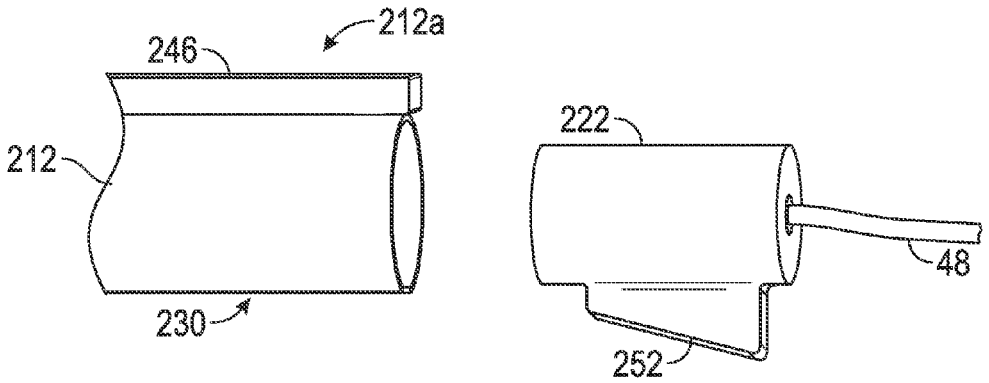
FIG. 13 is a side perspective view of an optional projectile positioned for loading into a muzzle end of a projectile launcher barrel.
Figure 14:
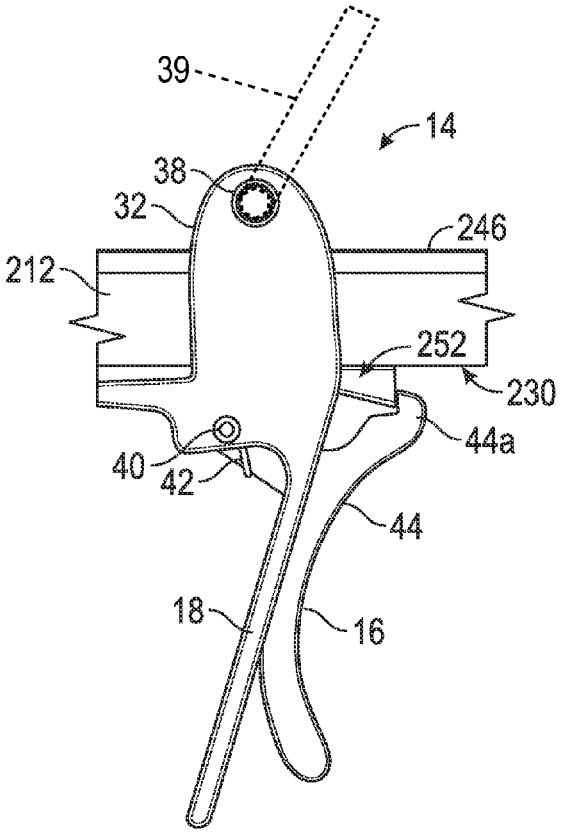
FIG. 14 is a side elevation of the trigger and barrel mount region of the projectile launcher with the optional projectile of FIG. 13 loaded therein.

Optionally, and with reference to FIGS. 13 and 14, a projectile 222 is configured for direct engagement with forward portion 20*a* of spring 20, without a sabot disposed between the spring and the projectile. Projectile 222 includes a trigger-catch 252, similar to trigger catch 152 of sabot 124, which moves longitudinally through a bottom slot 230 formed in a barrel 212. Trigger-catch 252 provides a ramped surface that urges trigger 16 downwardly (and toward handgrip 18) until projectile 222 is fully seated and tip portion 44*a* "snaps" into the retaining position at a forward end of trigger-catch 252, such as shown in FIG. 14. In the illustrated embodiment of FIGS. 13 and 14, barrel 212 has slot 230 defined fully to the forwardmost extend of muzzle or forward end portion 212*a*, with an upper protrusion 246 that corresponds to upper protrusion 146 described above. Projectile line 48 is coupled directly to a forward end of projectile 222, and may be held by a support clip, such as described above.

Other types of sabot or plug or other object may be used between spring 20 and projectile 22, and while it is envisioned that a sabot can aid in cocking the spring 20, in positioning projectile 22 in barrel 12, and in transferring energy to the projectile, the sabot is optional and could be eliminated so that spring 20 contacts projectile 22 directly, with the trigger engaging either the projectile or the forward end region of the spring to retain the spring in a compressed configuration prior to launching the projectile. When a sabot is used, it may take the form of substantially any object that is positionable between the spring and the projectile, and is movable in the barrel. A sabot need not be attached to the spring, although to avoid waste and creating litter it is generally desirable to retain the sabot in the barrel, or at least to retain the sabot at the launcher. A sabot may be connected to the spring via a friction fit inside the spring, or in a threaded manner, or with latching surfaces that engage the spring, or with adhesives, welding, or the like.

Figure 6A:
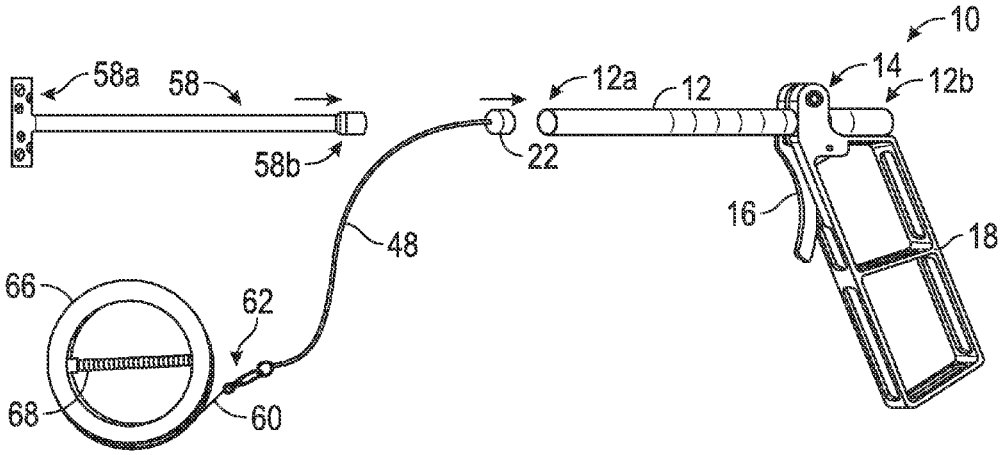
FIGS. 6A-6D are perspective views depicting sequential steps of loading and aiming the projectile launcher of FIG. 5.
Figure 6B:
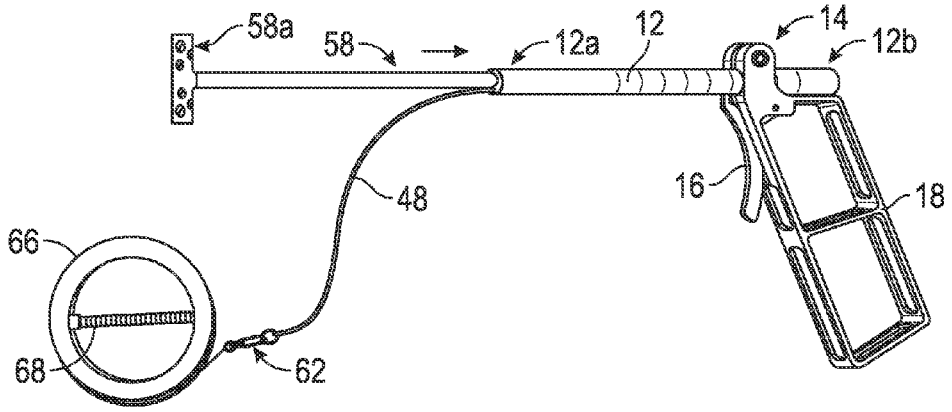
Figure 6C:
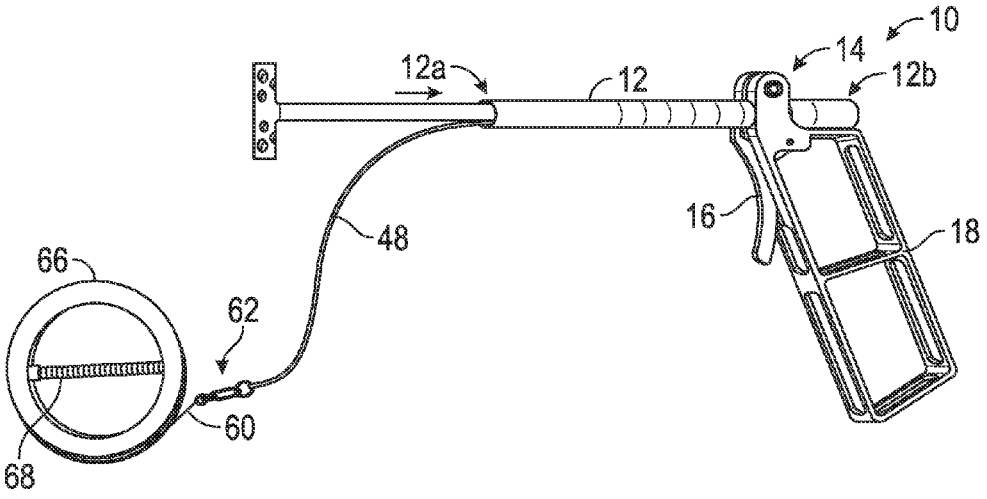
Figure 6D:
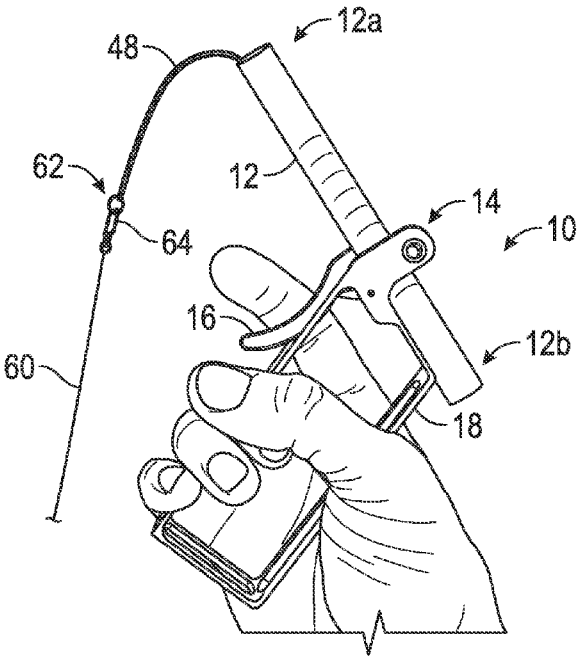

Referring now to FIGS. 6A-6D, projectile launcher 10 is prepared for launching projectile 22 by first loading the projectile into the open forward end 12*a* of barrel 12 (FIG. 6A), using an optional cocking rod 58 to urge projectile 22 further into barrel 12, thus compressing spring 20 until the sabot 24 is engaged by upper projection 44 of trigger 16 (FIGS. 6B and 6C). In the illustrated sequence of FIGS. 6A-6D, the cocking rod 58 is used to push projectile 22 into barrel 12 while compressing the spring, such that projectile 22 may be engaged directly by upper projection 44 of trigger 16. However, it will be appreciated that when the projectile does not engage the trigger, such as when a sabot is used in barrel 12 or when the trigger's upper projection 44 directly engages forward end portion 20*a* of spring 20, a more typical cocking sequence would be to use cocking rod 58 to push directly against the sabot or spring to compress the spring until the sabot (when present) is held in place by the trigger, after which the projectile could be loaded into barrel 12 without using the cocking rod.

Cocking rod 58 has a gripping portion 58*a* and a loading end portion 58*b*, which has a sufficiently small outer diameter to be received inside barrel 12 while also providing sufficient space for projectile line 48 to exit the barrel. Sabots 24, 124 may be shaped so that they will be automatically engaged by upper projection 44 of trigger 16 once a given sabot 24, 124 is positioned at the appropriate location along the barrel. For example, trigger-catch 152 of sabot 124 provides a ramped surface that urges trigger 16 downwardly (and toward handgrip 18) until the sabot 124 is fully seated and tip portion 44*a* "snaps" into the retaining position shown in FIGS. 8-10. By further example, another sabot may have a chamfered rear (tail) portion, and a recess or circumferential groove located forward of the chamfered rear portion, so that tip portion 44*a* will be biased downwardly by engagement of the chamfered rear portion, and then will be biased upwardly by spring 20 upon engagement of tip portion 44*a* in the recess or circumferential groove.

In the illustrated embodiments of FIGS. 6A-6D, projectile 22 is attached to projectile line 48, which is a relatively short length of abrasion-resistant cord or line, typically having a length that is somewhat greater than the length of barrel 12. Projectile line 48 is releasably attached to a lighter weight projectile line 60 via a quick-disconnect coupling 62, which may include some form of releasable clip or the like (as will be described below), and may further include a swivel 64 (FIG. 6D) to reduce twisting of the projectile lines 48, 60. Taken together, projectile 22 and projectile line 48 (with or without quick-disconnect coupling 62) may be considered a projectile assembly, which is selectively attachable and detachable from lighter projectile line 60. Lighter projectile line 60 is wrapped around a spool 66 that, in the illustrated embodiment, includes a central rod or gripping portion 68 that facilitates rewinding lighter projectile line 60 around spool 66 after use. Lighter projectile line 60 is readily dispensable from spool 66 upon launching of projectile 22.

Figure 15:
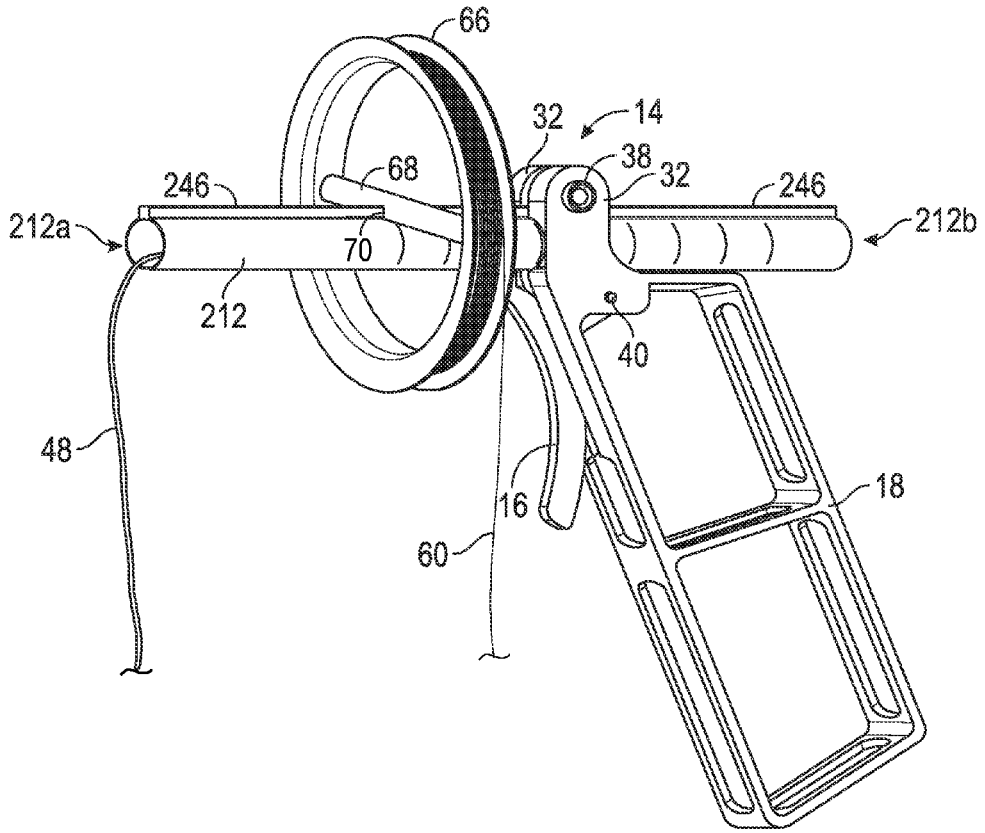
FIG. 15 is a front perspective view of another projectile launcher in accordance with the present invention, shown with a projectile line spool mounted at the barrel.

Optionally, and with reference to FIG. 15, spool 66 may be configured for attachment to barrel 212, such as by providing a notch 70 in central rod 68. Notch 70 receives upper protrusion 246, so that a central axis of spool 66 is substantially aligned with (or generally parallel to) the longitudinal axis of barrel 212. In this arrangement, the projectile will be launched in a direction that is substantially coaxial with spool 66, allowing the lighter projectile line 60 to be let out from spool 66 with minimal drag and, therefore, greater launch height or distance. It is further envisioned that the spool could be manually held near the barrel by the user, or the spool could be mounted in a location spaced radially outboard of the barrel.

Figure 11:
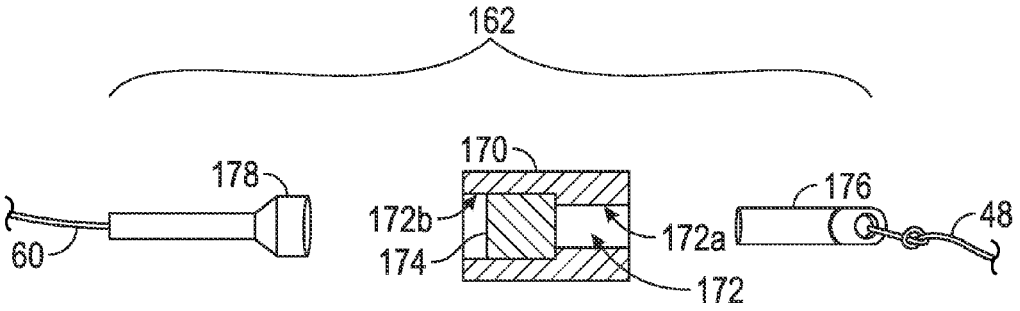
FIG. 11 is a side perspective view and partial sectional elevation showing an optional quick-disconnect assembly with magnetic release for use with the projectile launcher, shown in a de-coupled configuration.
Figure 12:
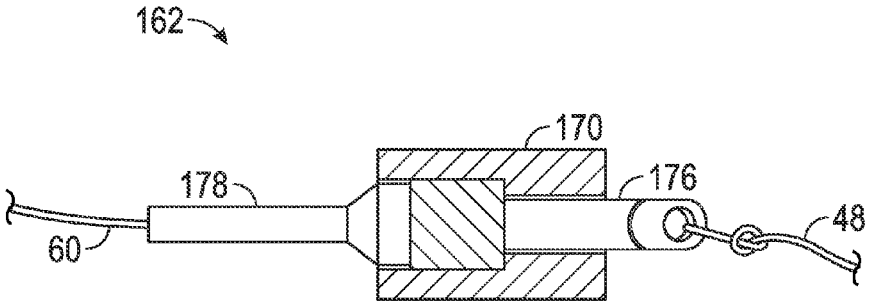
FIG. 12 is a side elevation and partial sectional view of the quick-disconnect assembly of FIG. 11, shown in a coupled configuration.

Quick-disconnect coupling 62 may be identical or substantially similar to a conventional snap-swivel arrangement commonly used for fishing line. However, referring to FIGS. 11 and 12 a remotely-releasable quick disconnect coupling 162 is provided, and includes a hollow coupling cylinder 170 having a dual-diameter bore 172 including a narrow-bore portion 172*a* and a wide-bore portion 172*b*. A magnet 174 is positioned in wide portion 172*b*. Flexible line 148 is attached to a cylindrical plug 176 that is sized and shaped to be received in narrow portion 172*a* of coupling cylinder 170, and is made of steel or other ferrous or magnetically-permeable material, so as to be attracted by magnet 174 and retained in narrow bore portion 172*a*. Similarly, another cylindrical plug 178 (made of the same or similar material as plug 176) is attached to lighter projectile line 60, with cylindrical plug 178 being sized and shaped for insertion into wider bore portion 172*b* of coupling cylinder 170, where it to is retained by magnet 174 (FIG. 12). It will be appreciated that the bore diameter can be continuous along its length, and that different bore diameters may be selected according to the desired weight of the coupling, the strength of the magnet (which could be replaced with a hook-and-loop fastener, for example), the magnetic permeability of the cylindrical plugs, and the desired retention strength at the coupling, so that the performance of the coupling can be tailored to meet a desired performance criteria.

In the event that projectile 22 or one of projectile lines 48, 60 becomes entangled or otherwise stuck, such as among tree branches after launching the projectile, the user may give a sharp tug on projectile line 60 in an attempt to separate one or both cylindrical plugs 176, 178 from coupling cylinder 170, thus causing lighter projectile line 60 and cylindrical plug 178 to drop to the ground, while also permitting coupling cylinder 170, cylindrical plug 176, and projectile line 48 to fall separately to the ground, so that the components may be recovered by the user and reassembled in the manner shown in FIG. 12, after which another projectile launching may be attempted. This technique is facilitated by using higher modulus (low stretch) projectile lines 48, 60 so that a sharp tug by the user translates into a sufficiently sharp (high acceleration) tug on plug 178 of quick disconnect coupling 162.

Optionally, a similar quick-disconnect coupling arrangement may be used for connecting the projectile directly to a projectile line. In such an arrangement, coupling cylinder 170 would be used as the projectile, with wider bore portion 172*b* positioned against the sabot, and with cylindrical plug 176 positioned in the narrower bore portion 172*a*, so that the projectile line attached to cylindrical plug 176 extends out of barrel 12, 112 prior to the launching of the coupling cylinder 170 out of the barrel. After the launching of coupling cylinder 170 as a projectile, the weight of the coupling cylinder causes it to fall to the ground with the projectile line(s) held to coupling cylinder 170 by magnet 174. Cylindrical plug 178 may then be attached to coupling cylinder 170, with a heavier and stronger line attached to plug 178, so that the projectile line(s) may be drawn downwardly by the user, so that quick disconnect coupling 162 and the heavier/stronger line may be drawn up and over the branch, as will be described in more detail below.

In the illustrated embodiment of FIGS. 1-9, hand grip 18 is of lightweight construction, and may comprise an aluminum framework that supports trigger 16 and is unitarily formed with barrel mount 14 at its upper end. However, if improved ergonomics are desired, a larger contoured handgrip may be substituted for handgrip 18, or may be attached to handgrip 18, particularly if the additional size, weight, and cost of an ergonomic handgrip are justified for a particular application. Handgrip 18 includes a forward-upper slot 80 that provides clearance for trigger 16 in the sabot-releasing position (FIG. 2), and which also increases the flexibility in the region where barrel mount 14 and handgrip 18 are conjoined, so that clamping spaces 36*a*, 36*b* may be more readily closed around barrel 12.

In a more basic form, it is envisioned that a projectile launcher may simply include a barrel, a barrel mount configured for grasping by the user, and a sabot having an elongated gripping tab or projection that extends radially outwardly from the barrel through a longitudinal slot. In such an arrangement, the user may simply position the barrel relative to the barrel mount according to the desired launch velocity, then draw the sabot rearwardly until its travel is limited by the barrel mount (or some form of stop structure associated with the barrel mount), and then the sabot may be manually released to launch the projectile from the barrel. Thus, it will be appreciated that a handgrip and a pivotable releasing trigger, as shown and described above with respect to the illustrated embodiments, are generally considered as optional components that enhance the usability of the device.

Many different uses are envisioned for projectile launcher 10, including but not limited to: target games, stringing wires through hard-to-reach areas, and as a teaching aid, but it is envisioned that projectile launcher 10 is particularly well suited for placing lines over tree branches, such as at campsites where it is desirable to suspend a food container, such as a "bear bag" above the ground, such as shown in FIGS. 16A-16F. Similar applications include placing lines over tree branches, such as by arborists and recreational tree climbers. Referring to FIG. 16A, a user 82 aims the cocked and loaded projectile launcher 10 upwardly at a selected tree branch 84 of a tree 86, and pulls the trigger 16 to launch projectile 22, which is attached to abrasion-resistant projectile line 48 and the lighter weight projectile line 60. Prior to launching projectile 22, user 82 sets the position of barrel 12 relative to barrel mount 14 at a desired location according to an estimated height of tree branch 84 above the ground. In the illustrated embodiment and for compactness of the drawings, branch 84 is shown lower to the ground than may be typical for suspending a food container or the like, but it will be appreciated that even a small hand-held projectile launcher 10 may be capable of launching a small projectile with attached projectile line to heights of 20-feet or more.

Figure 16B:
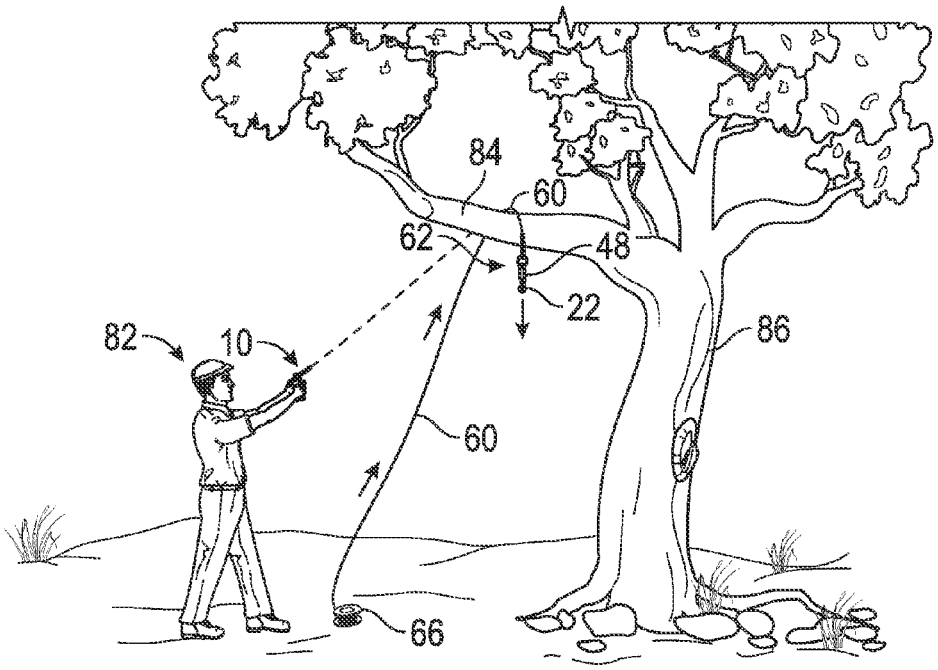
Figure 16C:
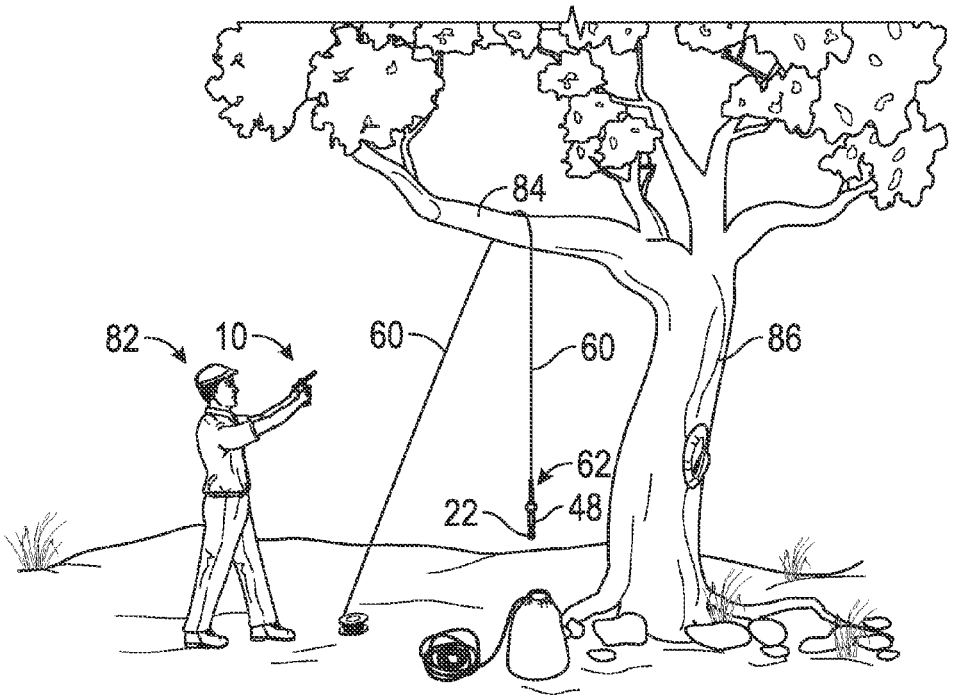
Figure 16D:
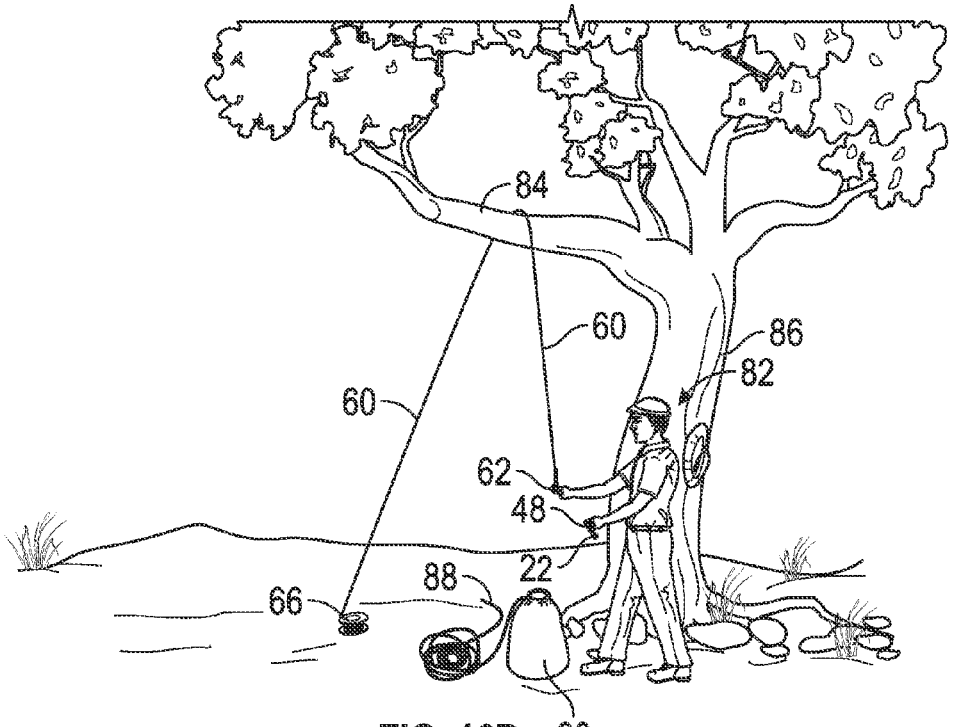
Figure 16E:
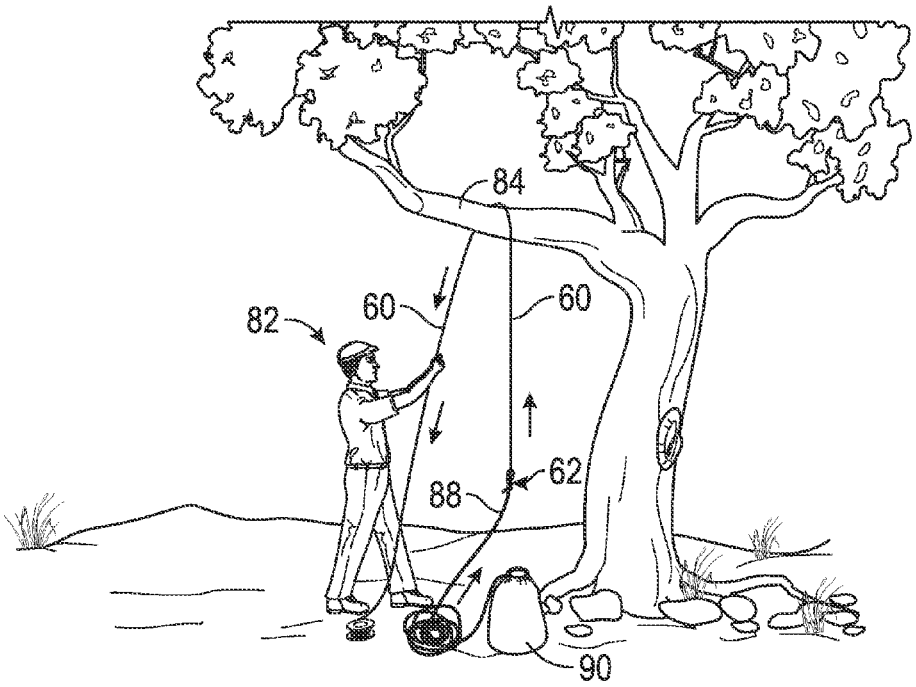
Figure 16F:
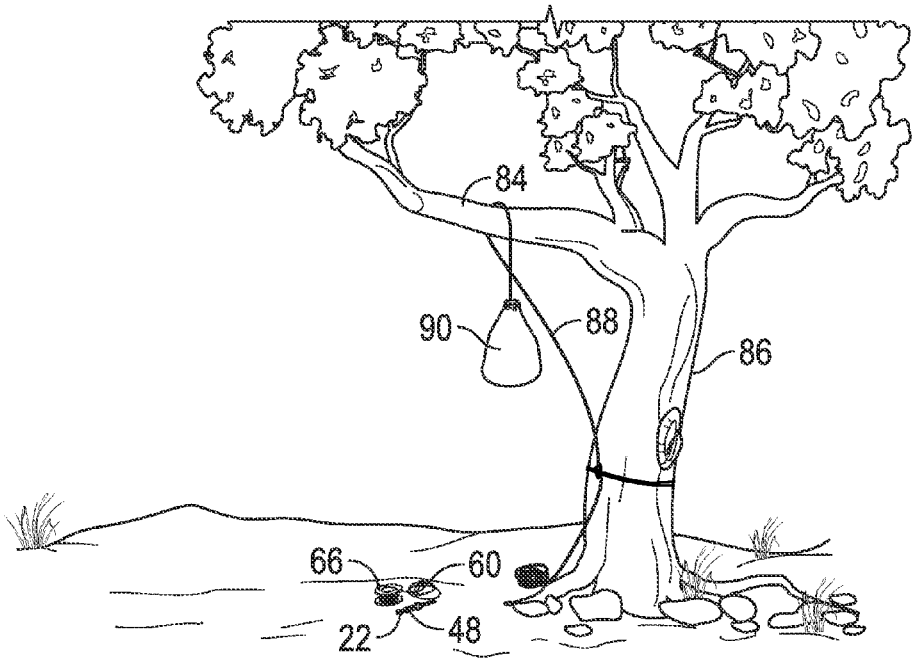

Assuming the selected barrel position and the user's aim are proper, projectile 22 will loop over branch 84 and carry lightweight projectile line 60 down toward the ground as additional projectile line 60 pays out from spool 66 (FIGS. 16B and 16C). User 82 then separates projectile 22 and projectile line 48 from the lighter projectile line 60 at quick-disconnect coupling 62, so that quick disconnect coupling 62 is then ready for attachment to a stronger (and typically heavier) line 88 that is associated with a container 90 (FIG. 16D). User 82 then pulls downwardly on the spool end of projectile line 60 to thereby draw container line 88 upwardly over tree branch 84 (FIG. 16E). Container line 88 may then be separated from lightweight projectile line 60, and container line 88 pulled further downwardly to thereby raise container 90 to an elevated position, with container line 88 then being tied off to tree 86, or at another location, to maintain container 90 in a suspended location below branch 84 (FIG. 16F).

The projectile launcher may be scaled to different sizes for different applications, and may utilize different springs or compressible members having different spring rates to achieve faster or slower muzzle velocities for projectiles, as desired. For example, when adapted for use as a target game, a larger bore barrel may be used to accommodate soft and/or lower-density projectiles, such as bean bags or balls or cylinders made of plastic or rubber or foam, which are less likely to cause injury if used improperly, compared with solid and/or dense projectiles. For other applications, it may be desirable to launch a heavier projectile, and/or a projectile with a heavier line, and/or a projectile to a greater height or distance, any of which may necessitate the use of a spring having a higher spring rate and/or a larger barrel to accommodate the spring.

Thus, the projectile launcher of the present invention provides a compact and lightweight device for launching a projectile a desired distance or height, such as for looping a lightweight flexible line over a desired branch of a tree, or for other applications in which it is desired to launch a given projectile different distances or heights according to the particular needs of a user. The discharge of velocity of the projectile is readily set by the user according to the position of the barrel relative to the barrel mount and trigger, while indicia along an outer surface of the barrel provides a visual reference for the user to select an appropriate position for the barrel according to the user's present needs. In addition, the projectile (or an abrasion-resistant lead line attached to the projectile), may be releasably coupled to a projectile line via a quick-disconnect coupling that also may facilitate subsequent attachment of the projectile line to a heavier and stronger line associated with a container to be suspended. The quick-disconnect coupling may also facilitate retrieval of the projectile in the event that the projectile and/or the associated projectile lines become snagged or entangled in branches or in other undesired locations.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A projectile launcher comprising:

a barrel mount configurable between a barrel-securing configuration and a barrel-releasing configuration;

a tubular barrel coupled to said barrel mount, wherein said barrel is longitudinally movable between a forward position and a rearward position when said barrel mount is in the barrel-releasing configuration; and a biasing member disposed in said barrel and compressible from a relaxed position to a first compressed position when said barrel is in the forward position, and to a second compressed position when said barrel is in the rearward position;

wherein said biasing member is operable to launch a projectile from said barrel at different speeds in response to said biasing member moving from the first or second compressed position to the relaxed position.

2. The projectile launcher of claim 1, wherein when said barrel is in the forward position a forward end of said barrel projects a first distance beyond said barrel mount, and when said barrel is in the rearward position the forward end of said barrel projects a second distance beyond said barrel mount, said second distance being shorter than said first distance.

3. The projectile launcher of claim 1, further comprising indicia spaced longitudinally along an outer surface of said barrel, said indicia corresponding to at least the forward and rearward positions of said barrel.

4. The projectile launcher of claim 1, wherein said biasing member is more compressed in the first compressed position than in the second compressed position, and wherein when the projectile is ejected from said barrel in the forward position, the projectile speed is greater than when the projectile is ejected from said barrel in the rearward position.

5. The projectile launcher of claim 1, further comprising a trigger configured to selectively retain said biasing member in the first or second compressed position, wherein said trigger is movable to a releasing position to thereby release said biasing member to the relaxed position.

6. The projectile launcher of claim 5, further comprising a sabot disposed in said barrel and positioned forwardly of said biasing member, said sabot configured to engage the projectile during launching thereof, and said sabot configured to be selectively engaged by said trigger to retain said biasing member in the first or second compressed position, wherein said trigger in the releasing position disengages the sabot.

7. The projectile launcher of claim 6, wherein said barrel defines a longitudinal slot along at least a portion thereof, and wherein said trigger comprises an engaging projection that extends inwardly through said longitudinal slot to engage said sabot when said trigger is in a retaining position.

8. The projectile launcher of claim 6, wherein said barrel defines a longitudinal slot along at least a portion thereof, and wherein said sabot comprises a projection that extends outwardly through said longitudinal slot and is engaged by said trigger when said trigger is in a retaining position.

9. The projectile launcher of claim 1, wherein said barrel mount comprises a clamping element that is operable to tighten said barrel mount around said barrel in the barrel-securing configuration, and wherein said barrel is repositionable and securable with said clamping element at substantially any position of said barrel at and between a forwardmost position and a rearwardmost position.

10. The projectile launcher of claim 1, further comprising:

an elongate ridge extending longitudinally along an outer surface of said barrel; and a slot defined in said barrel mount for receiving said elongate ridge;

wherein said barrel mount maintains said barrel in a rotationally fixed position, via engagement of said elongate ridge in said slot, as said barrel is moved between the forward position and the rearward position.

11. The projectile launcher of claim 1, further in combination with a projectile assembly, said projectile assembly comprising said projectile and a flexible line releasably coupled to said projectile.

12. The projectile launcher of claim 1, further comprising a handgrip coupled to said barrel mount.

13. A projectile launcher comprising:

a tubular barrel having an open forward end and a backstop, said barrel defining one or more openings arranged longitudinally along said barrel;

a spring disposed in said barrel, said spring having a rearward end positioned at said backstop and a movable forward end, wherein said spring is compressible from a relaxed position to one of at least two compressed positions in which said forward end is moved closer to said rearward end;

a barrel mount supporting said barrel and configurable between a barrel-securing configuration and a barrel-releasing configuration; and a trigger coupled to said barrel mount, said trigger having a retaining portion configured to selectively retain said spring in the at least two compressed positions, and said trigger being movable to a releasing position to thereby release said spring to the relaxed position;

wherein when said barrel mount is in said barrel-securing configuration, said barrel is substantially fixed in position relative to said trigger, and when said barrel mount is in said barrel-releasing configuration, said barrel is movable in a longitudinal direction relative to said trigger between at least two longitudinal positions corresponding to respective ones of the at least two compressed positions of said spring; and wherein said spring is operable to launch a projectile from said barrel at different speeds in response to said spring moving to the relaxed position from different ones of the at least two compressed positions.

14. The projectile launcher of claim 13, further comprising a sabot disposed in said barrel and positioned forwardly of said spring, said sabot configured to engage the projectile during launching thereof, and said sabot configured to be selectively engaged by said trigger to retain said spring in either of the at least two compressed positions, wherein said trigger in the releasing position disengages the sabot.

15. The projectile launcher of claim 14, wherein said trigger comprises an engaging projection that extends inwardly through one of said one or more openings to engage said sabot when said trigger is in a retaining position.

16. The projectile launcher of claim 14, wherein said sabot comprises a projection that extends outwardly through one of said one or more openings and is engaged by said trigger when said trigger is in a retaining position.

17. A method of launching a projectile, said method comprising:

positioning a tubular barrel at a desired one of at least two different longitudinal positions relative to a barrel mount according to a desired projectile launch distance or height;

fixing the barrel relative to the barrel mount at the desired position;

loading a projectile into an open forward end of the barrel, wherein said loading includes compressing a biasing member in the barrel from a relaxed configuration to one of at least two different compressed positions that corresponds to the desired one of the at least two different longitudinal positions of the barrel;

retaining the biasing member in the one of the at least two different compressed positions; and releasing the biasing member to eject the projectile from the barrel, wherein a speed of the projectile exiting the barrel generally corresponds to the longitudinal position of the barrel relative to the barrel mount.

18. The method of claim 17, wherein a first of the at least two different longitudinal positions of the barrel corresponds to a forward position of the barrel relative to the barrel mount and a second of the at least two different longitudinal positions of the barrel corresponds to a rearward position of the barrel relative to the barrel mount, and wherein the speed of the projectile exiting the barrel is greater when the barrel is in the forward position than when the barrel is in the rearward position.

19. The method of claim 17, further comprising:

attaching a flexible line to the projectile;

selecting the desired one of the at least two different longitudinal positions of the barrel according to a height of a selected tree branch;

aiming the tubular barrel generally at or above the tree branch prior to said releasing the biasing member, whereby said releasing the biasing member causes the projectile and flexible line to loop over the tree branch;

attaching the flexible line to a container line associated with a container;

drawing the container line over the branch using the flexible line; and raising the container by pulling the container line so as to support the container at the branch.

20. The method of claim 19, further comprising detaching the projectile from the flexible line via a quick-disconnect coupling prior to said attaching the flexible line to the container line.

* * * * *